US009523318B2

(12) United States Patent
Miyauchi et al.

(10) Patent No.: US 9,523,318 B2
(45) Date of Patent: Dec. 20, 2016

(54) AIR-FUEL RATIO CONTROL APPARATUS FOR INTERNAL COMBUSTION ENGINE AND METHOD FOR CONTROLLING AIR-FUEL RATIO

(75) Inventors: Atsuhiro Miyauchi, Wako (JP); Tooru Sekiguchi, Wako (JP); Michinori Tani, Wako (JP); Seiji Watanabe, Wako (JP)

(73) Assignee: HONDA MOTOR CO., LTD., Tokyo (JP)

( * ) Notice: Subject to any disclaimer, the term of this patent is extended or adjusted under 35 U.S.C. 154(b) by 1048 days.

(21) Appl. No.: 13/557,221

(22) Filed: Jul. 25, 2012

(65) Prior Publication Data

US 2013/0090834 A1 Apr. 11, 2013

(30) Foreign Application Priority Data

Oct. 11, 2011 (JP) ..... 2011-223552

(51) Int. Cl.
*F02D 41/00* (2006.01)
*F02D 41/14* (2006.01)
*F02D 41/28* (2006.01)

(52) U.S. Cl.
CPC ..... *F02D 41/0085* (2013.01); *F02D 41/1401* (2013.01); *F02D 41/1456* (2013.01); *F02D 41/1495* (2013.01); *F02D 2041/288* (2013.01)

(58) Field of Classification Search
CPC F02D 41/1454; F02D 41/2454; F02D 41/008; F02D 41/1456; F02D 41/2441; F02D 41/1476; F02D 41/1479; F02D 41/1482; F02D 41/0002; F02D 2041/001; G01N 27/4065; G01M 15/11; G01L 23/225
USPC ..... 123/672–674, 693–696
See application file for complete search history.

(56) References Cited

U.S. PATENT DOCUMENTS

| | | | | |
|---|---|---|---|---|
| 5,048,490 | A * | 9/1991 | Nakaniwa | 123/479 |
| 7,027,910 | B1 * | 4/2006 | Javaherian et al. | 701/111 |
| 7,900,615 | B2 * | 3/2011 | Wang et al. | 123/672 |
| 2008/0154476 | A1 * | 6/2008 | Takubo | 701/101 |
| 2011/0192146 | A1 * | 8/2011 | Sugimoto et al. | 60/276 |

(Continued)

FOREIGN PATENT DOCUMENTS

| | | | | |
|---|---|---|---|---|
| JP | 2009270543 | A * | 11/2009 | |
| JP | 2011-144754 | A | 7/2011 | |
| JP | 2011144754 | * | 7/2011 | F02D 41/14 |

*Primary Examiner* — Hung Q Nguyen
*Assistant Examiner* — Brian P Monahon
(74) *Attorney, Agent, or Firm* — Mori & Ward, LLP

(57) ABSTRACT

An air-fuel ratio control apparatus includes an air-fuel ratio detector, an oscillation signal generator, an air-fuel ratio oscillation device, a sum/difference frequency component intensity calculator, a decision parameter calculator, and an imbalance failure determination device. The sum/difference frequency component intensity calculator is configured to calculate, while the air-fuel ratio oscillation device is in operation, at least one of a component intensity of a difference frequency and a component intensity of a sum frequency. The decision parameter calculator is configured to calculate, according to at least one of the component intensity of the difference frequency and the component intensity of the sum frequency, a decision parameter to determine a degree of imbalance of an air-fuel ratio. The imbalance failure determination device is configured to determine an imbalance failure in which the degree of imbalance of the air-fuel ratio exceeds an allowable limit using the decision parameter.

6 Claims, 9 Drawing Sheets

(56) References Cited

U.S. PATENT DOCUMENTS

2011/0295491 A1* 12/2011 Kurahashi ..... F02D 41/0085
701/103

* cited by examiner

AIR-FUEL RATIO CONTROL APPARATUS FOR INTERNAL COMBUSTION ENGINE AND METHOD FOR CONTROLLING AIR-FUEL RATIO

CROSS-REFERENCE TO RELATED APPLICATIONS

The present application claims priority under 35 U.S.C. §119 to Japanese Patent Application No. 2011-223552, filed Oct. 11, 2011, entitled "Air-Fuel Ratio Control Apparatus for Internal Combustion Engine." The contents of this application are incorporated herein by reference in their entirety.

BACKGROUND OF THE INVENTION

1. Field of the Invention

The disclosure relates to an air-fuel ratio control apparatus for an internal combustion engine and a method for controlling an air-fuel ratio.

2. Discussion of the Background

Japanese Unexamined Patent Application Publication No. 2011-144754 discloses an air-fuel ratio control apparatus having a function of determining an imbalance failure based on the output signal of an air-fuel ratio sensor provided in the exhaust system of an engine. This apparatus executes air-fuel ratio oscillation control to oscillate the air-fuel ratio at a predetermined frequency while the engine is in operation, and determines an imbalance failure using a decision parameter obtained by dividing a 0.5th-order frequency component intensity included in the output signal of the air-fuel ratio sensor by the component intensity of the predetermined frequency. The 0.5th-order frequency component is the component of a half of a frequency corresponding to the rotational speed of the engine. When an imbalance failure occurs, the intensity of the 0.5th-order frequency component increases. The greater the degree of imbalance is, the greater the value of the decision parameter becomes. It is therefore possible to determine an imbalance failure by comparing the decision parameter with a predetermined threshold value.

SUMMARY OF THE INVENTION

According to one aspect of the present invention, an air-fuel ratio control apparatus for an internal combustion engine includes an air-fuel ratio detector, an oscillation signal generator, an air-fuel ratio oscillation device, a sum/difference frequency component intensity calculator, a decision parameter calculator, and an imbalance failure determination device. The air-fuel ratio detector is configured to detect an air-fuel ratio in an exhaust passage provided in the internal combustion engine including a plurality of cylinders. The oscillation signal generator is configured to generate an oscillation signal to oscillate the air-fuel ratio at a set frequency different from a 0.5th-order frequency which is a half of a frequency corresponding to a rotational speed of the internal combustion engine. The air-fuel ratio oscillation device is configured to oscillate the air-fuel ratio according to the oscillation signal. The sum/difference frequency component intensity calculator is configured to calculate, while the air-fuel ratio oscillation device is in operation, at least one of a component intensity of a difference frequency and a component intensity of a sum frequency. The difference frequency corresponds to a difference between the 0.5th-order frequency and the set frequency which are included in an output signal of the air-fuel ratio detector. The sum frequency corresponds to a sum of the 0.5th-order frequency and the set frequency which are included in the output signal of the air-fuel ratio detector. The decision parameter calculator is configured to calculate, according to at least one of the component intensity of the difference frequency and the component intensity of the sum frequency, a decision parameter to determine a degree of imbalance of the air-fuel ratio corresponding to each of the plurality of cylinders. The imbalance failure determination device is configured to determine an imbalance failure in which the degree of imbalance of the air-fuel ratio exceeds an allowable limit using the decision parameter.

According to another aspect of the present invention, a method for controlling an air-fuel ratio includes detecting an air-fuel ratio in an exhaust passage provided in an internal combustion engine including a plurality of cylinders; generating an oscillation signal to oscillate the air-fuel ratio at an oscillation frequency different from a 0.5th-order frequency which is a half of a frequency corresponding to a rotational speed of the internal combustion engine; oscillating the air-fuel ratio according to the oscillation signal; calculating, while the air-fuel ratio is oscillated, at least one of a component intensity of a difference frequency and a component intensity of a sum frequency, the difference frequency corresponding to a difference between the 0.5th-order frequency and the oscillation frequency which are included in an output signal generated in the detecting of the air-fuel ratio, the sum frequency corresponding to a sum of the 0.5th-order frequency and the oscillation frequency which are included in the output signal; calculating, according to at least one of the component intensity of the difference frequency and the component intensity of the sum frequency, a decision parameter to determine a degree of imbalance of the air-fuel ratio corresponding to each of the plurality of cylinders; and determining an imbalance failure in which the degree of imbalance of the air-fuel ratio exceeds an allowable limit using the decision parameter.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings.

DESCRIPTION OF THE EMBODIMENTS

Figure 1:
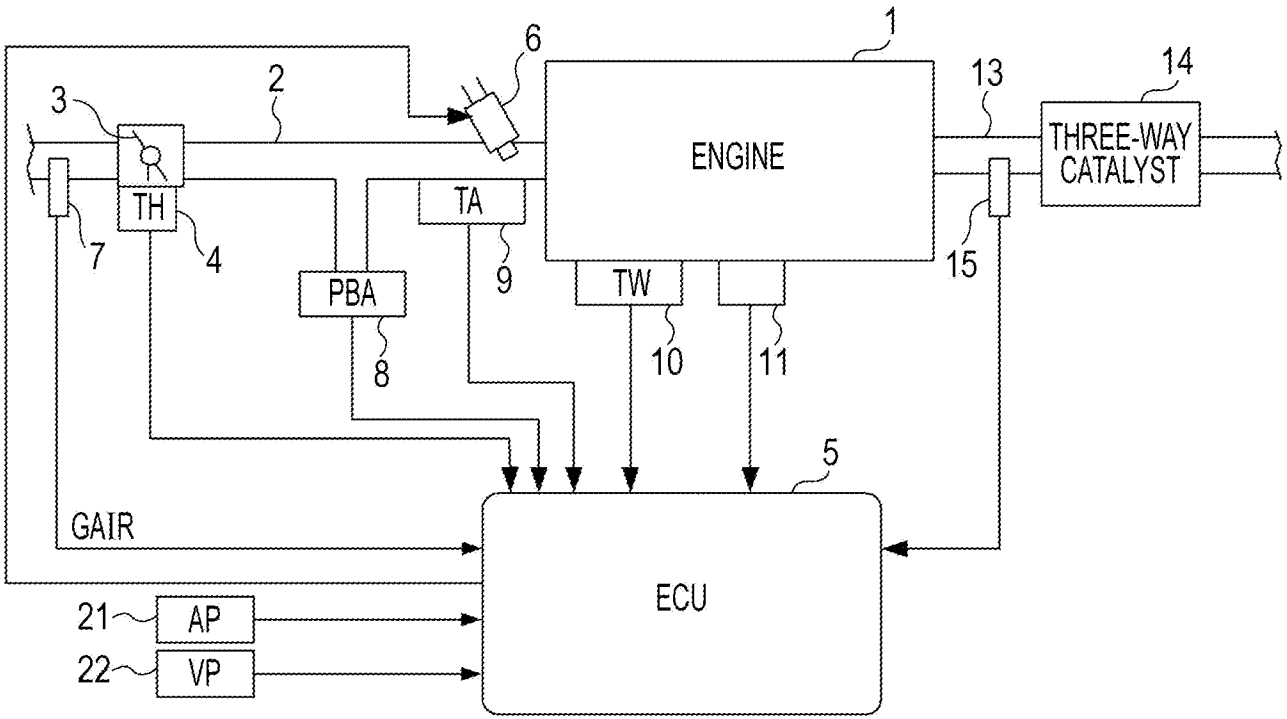
FIG. 1 is a diagram showing the configuration of an internal combustion engine and a control apparatus therefor according to an exemplary embodiment of the disclosure.

The embodiments will now be described with reference to the accompanying drawings, wherein like reference numerals designate corresponding or identical elements throughout the various drawings.

First Embodiment

FIG. 1 is a diagram showing the general configuration of an internal combustion engine (hereinafter referred to as "engine") 1 and an air-fuel ratio control apparatus therefor according to an exemplary embodiment of the disclosure. A throttle valve 3 is disposed in an intake pipe 2 of the engine 1 of, for example, a four-cylinder type. A throttle valve opening degree sensor 4 which detects a throttle valve opening angle TH is coupled to the throttle valve 3. A detection signal from the throttle valve opening degree sensor 4 is supplied to an electronic control unit (hereinafter referred to as "ECU") 5.

A fuel injection valve 6 is provided between the engine 1 and the throttle valve 3 and slightly upstream of an intake valve (not shown) in the intake pipe 2. The individual fuel injection valves 6 are connected to a fuel pump (not shown), and are electrically connected to the ECU 5, so that the open times of the fuel injection valves 6 are controlled by a signal from the ECU 5.

An intake air flow rate sensor 7 which detects an intake air flow rate GAIR is provided upstream of the throttle valve 3. A suction pressure sensor 8 which detects a suction pressure PBA, and a suction temperature sensor 9 which detects a suction temperature TA are provided downstream of the throttle valve 3. Detection signals from those sensors are supplied to the ECU 5. A coolant temperature sensor 10 which detects an engine coolant temperature TW is mounted on the body of the engine 1, and a detection signal from the coolant temperature sensor 10 is supplied to the ECU 5.

The ECU 5 is connected with a crank angle position sensor 11 which detects the rotational angle of the crank shaft (not shown) of the engine 1, so that a signal according to the rotational angle of the crank shaft is supplied to the ECU 5. The crank angle position sensor 11 includes a cylinder discrimination sensor which outputs a pulse at a predetermined crank angle position of a certain cylinder of the engine 1 (hereinafter referred to as "CYL pulse"), a TDC sensor which outputs a TDC pulse at a crank angle position (every crank angle of 180 degrees in a four-cylinder engine) before a predetermined crank angle with regard to a top dead center (TDC) when the suction stroke of each cylinder starts, and a CRK sensor which generates one pulse (hereinafter referred to as "CRK pulse"), shorter than the TDC pulse, at a constant crank angle period (e.g., period of 6 degrees). The CYL pulse, the TDC pulse and the CRK pulse are supplied to the ECU 5. Those pulses are used in controlling various timings such as fuel injection timing and ignition timing, and detecting the number of engine rotations (engine speed) NE.

A three-way catalyst 14 is provided in an exhaust passage 13. The three-way catalyst 14 is capable of storing oxygen. The three-way catalyst 14 stores oxygen in the emission in an exhaust lean state where the air-fuel ratio of the air-fuel mixture supplied to the engine 1 is set leaner than the theoretical air-fuel ratio so that the oxygen concentration in the emission is relatively high. In an exhaust rich state where the air-fuel ratio of the air-fuel mixture supplied to the engine 1 is set richer than the theoretical air-fuel ratio so that the oxygen concentration in the emission is low and the amounts of HC and CO components in the emission are large, on the other hand, the three-way catalyst 14 is capable of oxidizing the HC and CO components in the emission with the stored oxygen.

A proportional oxygen concentration sensor (hereinafter referred to as "LAF sensor") 15 is mounted upstream of the three-way catalyst 14 and downstream of the collected portion of an exhaust manifold connecting to the individual cylinders. The LAF sensor 15 produces a detection signal substantially proportional to the oxygen concentration (air-fuel ratio) in the emission, and supplies the detection signal to the ECU 5.

The ECU 5 is connected with an accelerator sensor 21 which detects the depression amount, AP, of the accelerator pedal of the vehicle driven by the engine 1 (hereinafter referred to as "accelerator pedal depression amount"), and a vehicle speed sensor 22 which detects a running speed (vehicle speed) VP of the vehicle. Detection signals from these sensors are supplied to the ECU 5. The throttle valve 3 is actuated to be opened or closed by an actuator (not shown), and the throttle valve opening angle TH is controlled according to the accelerator pedal depression amount AP by the ECU 5.

The engine 1 is provided with a well-known emission circulation mechanism though not illustrated.

The ECU 5 includes an input circuit having various functions of, for example, shaping input signal waveforms from various sensors, correcting a voltage level to a predetermined level, and converting an analog signal value to a digital signal value, a central processing unit (hereinafter referred to as "CPU"), a memory circuit which stores various operation programs to be executed by the CPU, operation results, etc., and an output circuit which supplies a drive signal to the fuel injection valves 6.

The CPU of the ECU 5 discriminates various engine operational states based on the detection signals from the aforementioned various sensors, and calculates a fuel injection time TOUT of each fuel injection valve 6 which is actuated to be open in synchronism with the TDC pulse, in accordance with the discriminated engine operational state using the following equation 1. Because the fuel injection time TOUT is substantially proportional to the amount of fuel injected, it is hereinafter called "fuel injection amount TOUT".

$$TOUT = TIM \times KCMD \times KAF \times KTOTAL \quad (1)$$

In the equation 1, TIM is a basic fuel amount, specifically the basic fuel injection time, and is determined searching a TIM table set according to the intake air flow rate GAIR. The TIM table is set so that the air-fuel ratio A/F of the air-fuel mixture to be combusted in the engine 1 substantially becomes the theoretical air-fuel ratio.

In the equation 1, KCMD is a target air-fuel ratio coefficient set according to the operational state of the engine 1. Because the target air-fuel ratio coefficient KCMD is proportional to the reciprocal of the air-fuel ratio A/F, i.e, a fuel-air ratio F/A, target and takes a value of 1.0 in case of the theoretical air-fuel ratio, the target air-fuel ratio coefficient is hereinafter referred to as "equivalence ratio". As will be described later, the target equivalence ratio KCMD is set in such a way that the target equivalence ratio KCMD changes sinusoidally in a range of 1.0±DAF with elapse of time when determining an imbalance failure of the air-fuel ratio.

In the equation 1, KAF is an air-fuel ratio correction coefficient which is calculated by adaptive control using PID (Proportional Integral and Differential) control or a self tuning regulator in such a way that a detection equivalence ratio KACT calculated from the value detected by the LAF sensor 15 matches with the target equivalence ratio KCMD when a condition for executing air-fuel ratio feedback control is satisfied.

In the equation 1, KTOTAL is a product of other correction coefficients (correction coefficient KTW according to the engine coolant temperature TW, correction coefficient KTA according to the suction temperature TA, etc.) to be calculated according to various engine parameter signals.

The CPU of the ECU 5 supplies the drive signal to open the fuel injection valves 6 to the fuel injection valves 6 via the output circuit based on the fuel injection amount TOUT obtained in the above-described manner. The CPU of the ECU 5 also performs imbalance failure determination on the air-fuel ratio in a manner described below.

The imbalance failure determination scheme according to the embodiment is an improvement of the scheme disclosed in Japanese Unexamined Patent Application Publication No. 2011-144754. According to the imbalance failure determination scheme, air-fuel ratio oscillation control to oscillate the air-fuel ratio with an oscillation frequency fOSL while the engine 1 is running is executed, and an imbalance failure is determined based on the ratio of a specific frequency component intensity included in the an output signal SLAF of the LAF sensor 15 during the control.

First, the problem of the scheme disclosed in Japanese Unexamined Patent Application Publication No. 2011-144754 (related art scheme) will be described below. When the degree of imbalance of the air-fuel ratio increases, a component intensity of a 0.5th-order frequency fIMB (hereinafter referred to as "0.5th-order frequency component intensity") MIMB equivalent to ½ of an engine speed frequency fNE (=NE/60) corresponding to an engine speed NE (rpm) increases. Provided that the component intensity of the oscillation frequency fOSL is an oscillation frequency component intensity MOSL, a decision parameter RT is calculated from the following equation 2.

$$RT=MIMB/MOSL \tag{2}$$

Figure 2A:
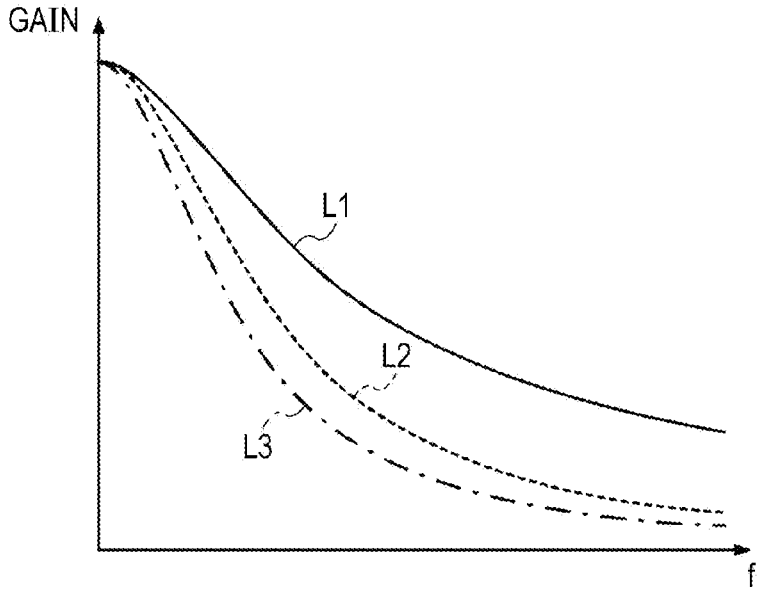
FIGS. 2A and 2B are diagrams for explaining the problems of the related art.
Figure 2B:
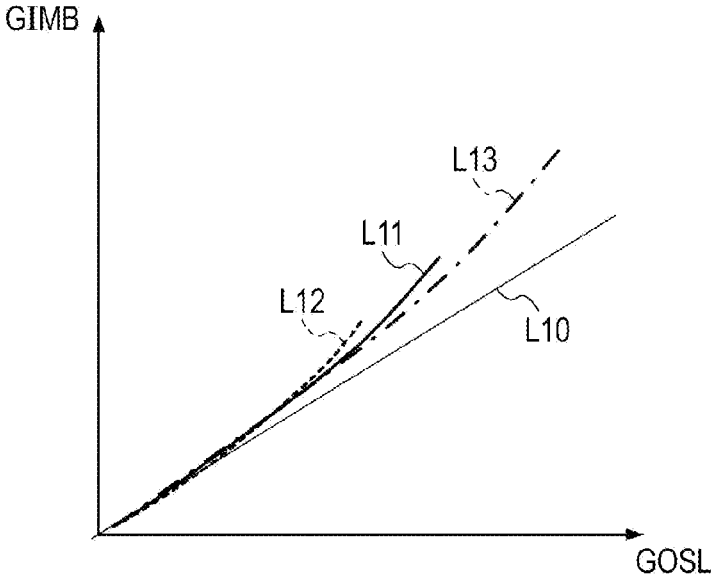

FIG. 2A is a diagram showing the response frequency characteristic (gain) of the LAF sensor 15; a solid line L1 shows the initial characteristic, and a dashed line L2 and a one-dot chain line L3 show deteriorated characteristics. Because those response frequency characteristics cannot be approximated by a first-order lag characteristic, a gain ratio RGAIN (=GIMB/GOSL) varies depending on the frequency f, and also varies according to the degree of deterioration of the response frequency characteristic of the LAF sensor 15. Consequently, with the oscillation frequency fOSL being set to 0.4 fNE, for example, the relation between the oscillation frequency gain GOSL and the 0.5th-order frequency gain GIMB is shown by curves L11 and L12, not a straight line L10 as shown in FIG. 2B. The solid line L11, the dashed line L12 and a one-dot chain line L13 respectively correspond to the deteriorated states indicated by the solid line L1, the dashed line L2 and the one-dot chain line L3 in FIG. 2A, and the engine speeds NE of 1800 rpm, 2400 rpm and 1200 rpm. Even when the degree of imbalance of the air-fuel ratio is constant, therefore, the decision parameter RT varies depending on the engine speed NE and the degree of deterioration of the LAF sensor characteristic. The variation of the decision parameter RT is a factor to lower the accuracy of determining an imbalance failure.

Although the air-fuel ratio oscillation control is carried out with the fuel injection amount TOUT changed by changing the target equivalence ratio KCMD and an oscillation amplitude DAF, the real equivalence ratio (air-fuel ratio) may not be changed by the oscillation amplitude DAF depending on the operational environment of the engine.

According to the embodiment, imbalance failure determination is carried out as described below based on the intensity of the difference frequency component and the intensity of the oscillation frequency component, both included in the LAF-sensor output signal SLAF when the air-fuel ratio oscillation control is underway.

Provided that a 0.5th-order frequency component WIMB and an oscillation frequency component WOSL as the input signals to the air-fuel ratio control system are expressed by the following equations 3 and 4, the output signal of the air-fuel ratio control system can be expressed by a product WPRD of both components as given by an equation 5. ωIMB and ωOSL (rad/sec) in the equations 3 to 5 are equivalent to (2π·fIMB) and (2π·fOSL), respectively.

$$WIMB = 1 + AIMB \times \sin(\omega IMB \cdot t) \tag{3}$$

$$WOSL = 1 + AOSL \times \sin(\omega OSL \cdot t) \tag{4}$$

$$\begin{aligned} WPRD &= WIMB \times WOSL \\ &= \{1 + AIMB \times \sin(\omega IMB \cdot t)\} \times \\ &\quad \{1 + AOSL \times \sin(\omega OSL \cdot t) \\ &= AIMB \times \sin(\omega IMB \cdot t) + AOSL \times \sin(\omega OSL \cdot t) + \\ &\quad \frac{AIMB \times AOSL}{2}\{\cos((\omega IMB - \omega OSL) \cdot t) - \\ &\quad \cos((\omega IMB + \omega OSL) \cdot t)\} + 1 \end{aligned} \tag{5}$$

As apparent from the equation 5, the LAF-sensor output signal SLAF includes the frequency component of the sum of the 0.5th-order frequency fIMB and the oscillation frequency fOSL and the frequency component of the difference therebetween together with the 0.5th-order frequency component of the first term and the oscillation frequency component of the second term. Hereinafter, the sum of the 0.5th-order frequency fIMB and the oscillation frequency fOSL is referred to as "sum frequency fSUM", the difference between the 0.5th-order frequency fIMB and the oscillation frequency fOSL is referred to as "difference frequency fDIF", the intensity of the frequency component corresponding to the sum frequency fSUM is referred to as "sum frequency component intensity MSUM", and the intensity of the frequency component corresponding to the difference frequency fDIF is referred to as "difference frequency component intensity MDIF".

Figure 3A:
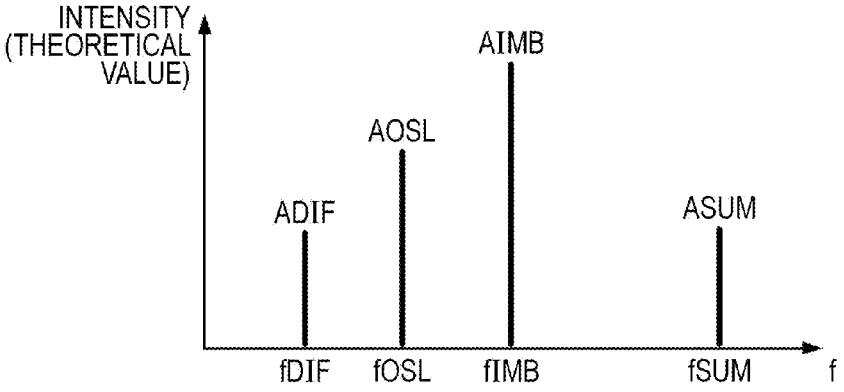
FIGS. 3A to 3C are diagrams for explaining the intensity of a frequency component included in a detected air-fuel ratio signal during execution of air-fuel ratio oscillation control.

The theoretical values of the individual frequency component intensities are proportional to amplitudes AIMB, AOSL and (AIMB·AOSL/2), so that with an imbalance failure occurring, the theoretical values have, for example, a correlation as shown in FIG. 3A. ADIF and ASUM in FIG. 3A are both equal to (AIMB·AOSL/2).

Figure 3B:
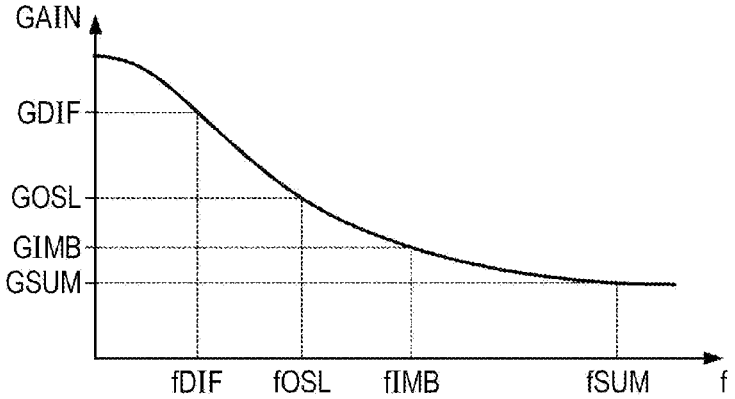
Figure 3C:
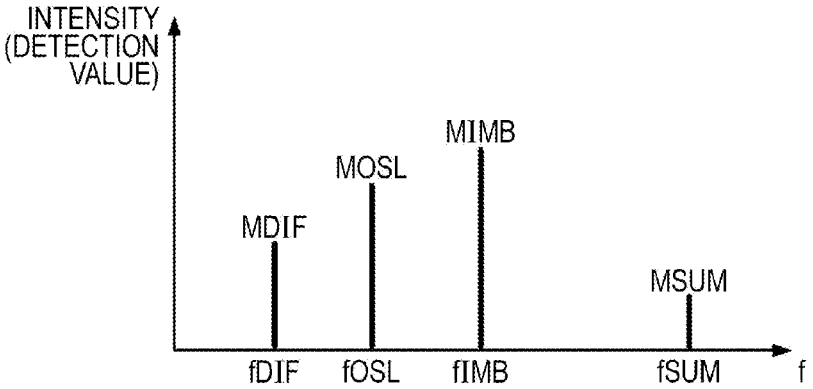

FIG. 3B shows the response frequency characteristic of the LAF sensor 15. The intensities MDIF, MOSL, MIMB and MSUM of the individual frequency components included in the LAF-sensor output signal SLAF can be respectively expressed by the following equations 6 to 9 using the amplitudes ADIF, AOSL, AIMB and ASUM.

$$MDIF=GDIF \times ADIF=GDIF \times (AIMB \cdot AOSL/2) \tag{6}$$

$$MOSL=GOSL \times AOSL \tag{7}$$

$$MIMB=GIMB\times AIMB \quad (8)$$

$$MSUM=GSUM\times ASUM=GSUM\times(AIMB\cdot AOSL/2) \quad (9)$$

According to the embodiment, therefore, a decision parameter RST is calculated from the following equation 10, and an imbalance failure is determined using this decision parameter RST.

$$RST=MDIF/MOSL=AIMB\times GDIF/(GOSL\times 2) \quad (10)$$

Because the oscillation signal amplitude AOSL is eliminated in the equation 10, even when the real air-fuel ratio oscillation amplitude differs from the amplitude of the control input, imbalance failure determination can be carried out without being influenced by the difference.

Figure 4:
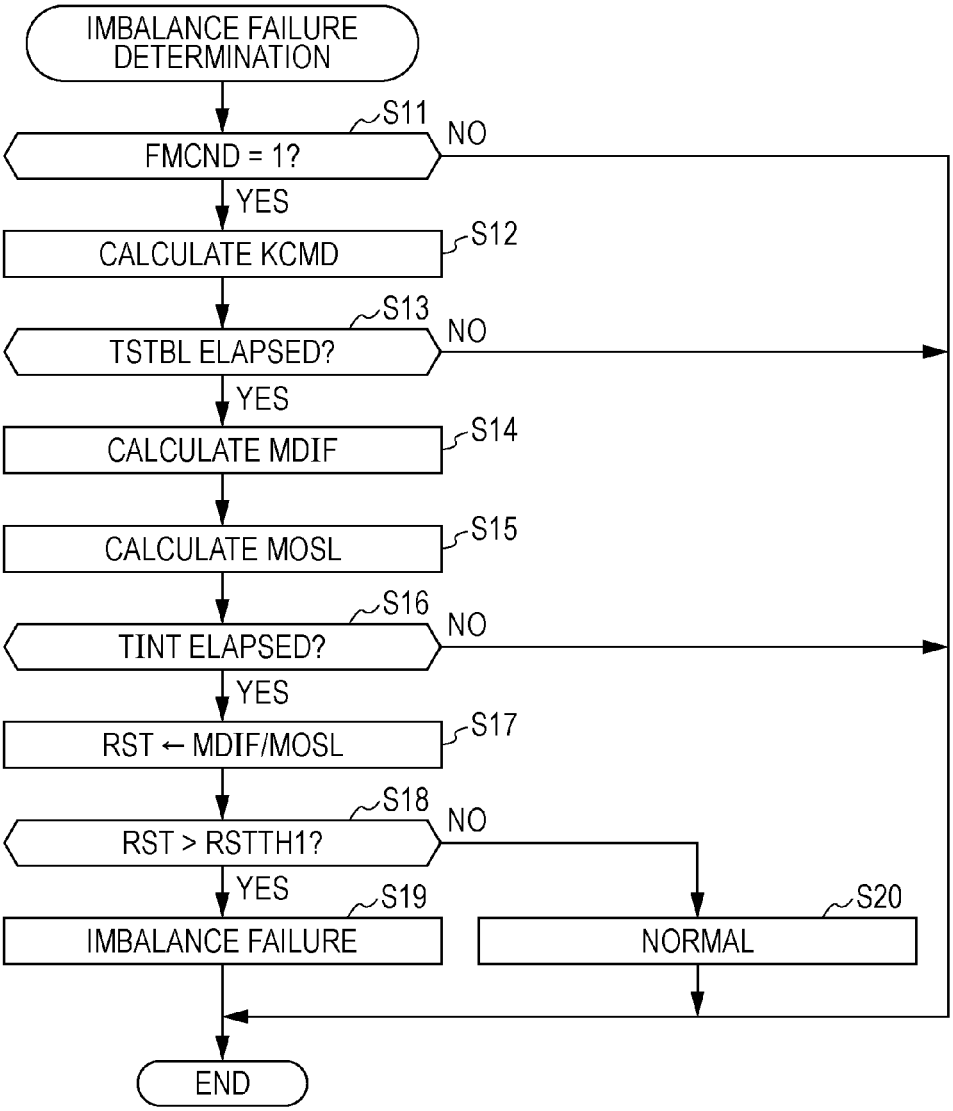
FIG. 4 is a flowchart of an imbalance failure determination routine (first embodiment).

FIG. 4 shows the flowchart of the imbalance failure determination routine according to the embodiment. This routine is executed every predetermined crank angle CACAL (e.g., 30 degrees) by the CPU of the ECU 5.

It is determined in step S11 whether a decision executing condition flag FMCND is "1". The decision executing condition flag FMCND is set to "1" when all of the following conditions 1 to 11 are fulfilled.

1) The engine speed NE lies within the range of predetermined upper and lower limits.

2) The suction pressure PBA is higher than a predetermined pressure (exhaust flow rate needed for the decision is secured).

3) The LAF sensor 15 is activated.

4) Air-fuel ratio feedback control according to the output of the LAF sensor 15 is executed.

5) The engine coolant temperature TW is higher than a predetermined temperature.

6) A change DNE in engine speed NE per unit time is smaller than a predetermined change in engine speed.

7) A change DPBAF in suction pressure PBA per unit time is smaller than a predetermined change in suction pressure.

8) An accelerated increase in fuel (which is executed upon rapid acceleration) is not carried out.

9) An emission circulation rate is greater than a predetermined value.

10) The LAF-sensor output is not fixed to the upper limit or the lower limit.

11) The response characteristic of the LAF sensor is normal (it is not decided that a failure originated from deterioration of the response characteristic has occurred).

When the decision in step S11 is negative (NO), the routine is terminated immediately. When FMCND=1, air-fuel ratio oscillation control is carried out as described below to perform imbalance failure determination. In executing the air-fuel ratio oscillation control, the air-fuel ratio correction coefficient KAF is fixed to "1.0".

In step S12, the target equivalence ratio KCMD is calculated from the following equation 11 where KfOSL is an oscillation frequency coefficient which is set to, for example, "0.4", and k is a discretization time at which discretization is effected at the execution period CACAL of this routine.

$$KCMD=DAF\times\sin(KfOSL\times CACAL\times k)+1 \quad (11)$$

It is determined in step S13 whether a predetermined stabilization time TSTBL has passed since the start of the air-fuel ratio oscillation control. When the decision in step S13 is negative (NO), the routine is terminated immediately. When the decision in step S13 is affirmative (YES), the difference frequency component intensity MDIF and the oscillation frequency component intensity MOSL, both included in the output signal SLAF of the LAF sensor 15 are executed in steps S14 and S15, respectively.

In step S14, band-pass filtering to extract a difference frequency (fDIF) component is executed, and the amplitude of the extracted signal is integrated to calculate the difference frequency component intensity MDIF. In step S15, band-pass filtering to extract an oscillation frequency (fOSL) component is executed, and the amplitude of the extracted signal is integrated to calculate the oscillation frequency component intensity MOSL.

It is determined in step S16 whether predetermined integration time TINT has passed since the start of the calculation of the frequency component intensity. When the decision in step S16 is negative (NO), the routine is terminated immediately. When the decision in step S16 is affirmative (YES), the calculated difference frequency component intensity MDIF is divided by the oscillation frequency component intensity MOSL (see the equation 10) to calculate the decision parameter RST (step S17).

It is determined in step S18 whether the decision parameter RST is greater than a predetermined decision parameter threshold value RSTTH1. When the decision in step S18 is affirmative (YES), it is decided that an imbalance failure where the degree of imbalance of the air-fuel ratio exceeds the allowable limit has occurred (step S19). When the decision in step S18 is negative (NO), on the other hand, it is decided that the degree of imbalance lies within the allowable limit (normal) (step S20).

According to the embodiment, as described above, the oscillation signal amplitude AOSL is eliminated in the equation 10 to calculate the decision parameter RST, so that even when the real air-fuel ratio oscillation amplitude differs from the amplitude of the control input, imbalance failure determination can be carried out without being influenced by the difference.

According to the embodiment, the LAF sensor 15 is equivalent to the air-fuel ratio detector, the fuel injection valve 6 is equivalent to a part of the air-fuel ratio oscillation device, the ECU 5 achieves the oscillation signal generator, a part of the air-fuel ratio oscillation device, the sum/difference frequency component intensity calculator, the set frequency component intensity calculator, the decision parameter calculator and the imbalance failure determination device. Specifically, step S12 in FIG. 4 is equivalent to the oscillation signal generator, step S14 in FIG. 4 is equivalent to the sum/difference frequency component intensity calculator, step S15 in FIG. 4 is equivalent to the set frequency component intensity calculator, step S17 in FIG. 4 is equivalent to the decision parameter calculator, and steps S18 to S20 in FIG. 4 are equivalent to the imbalance failure determination device.

Modification

The decision parameter RST may be calculated from the following equation 12 instead of the equation 10. That is, the sum frequency component intensity MSUM may be divided by the oscillation frequency component intensity MOSL to calculate the decision parameter RST.

$$RST=MSUM/MOSL=AIMB\times GSUM/(GOSL\times 2) \quad (12)$$

Figure 5:
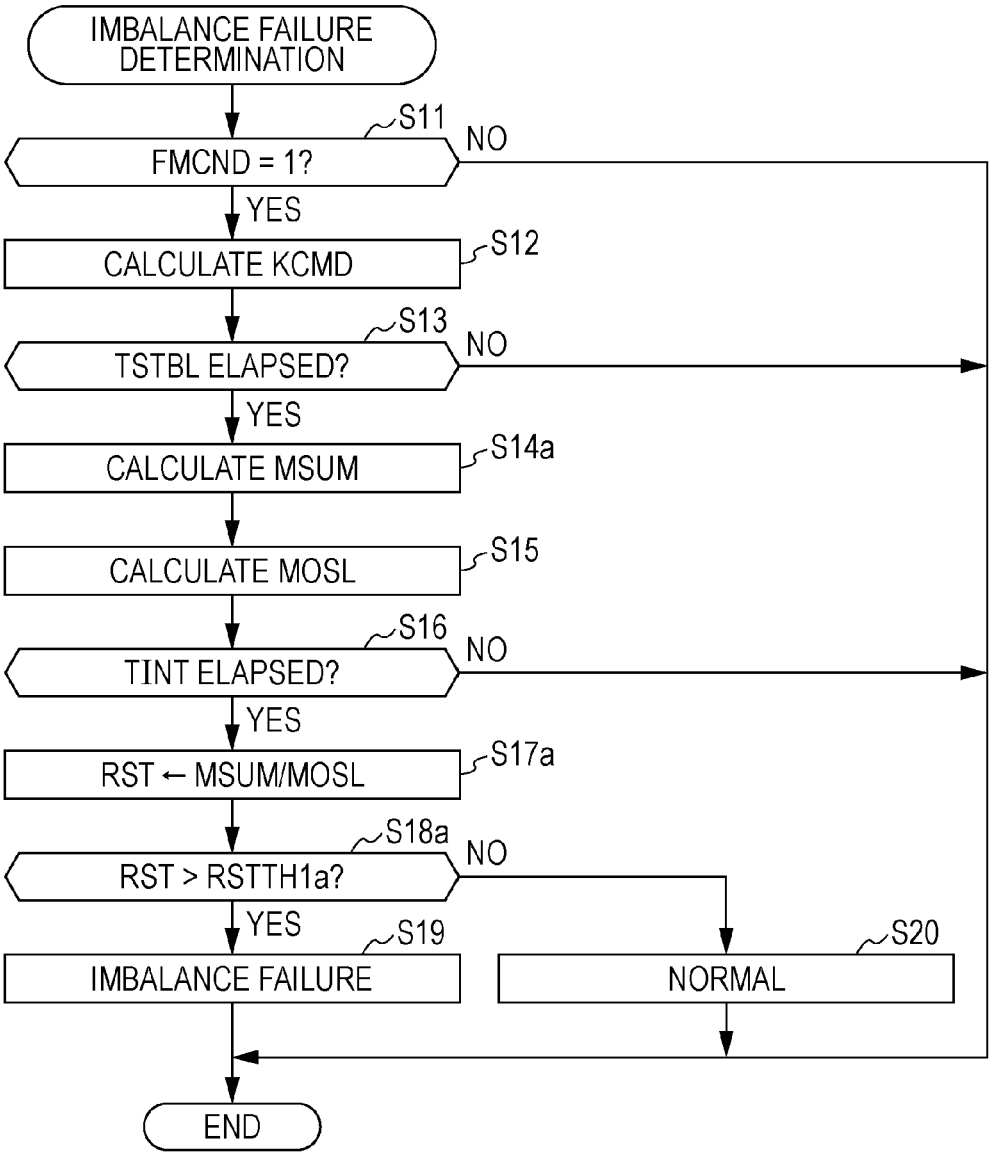
FIG. 5 is a flowchart of an imbalance failure determination routine (modification of the first embodiment).

FIG. 5 shows the flowchart of the modification, with steps S14, S17 and S18 in FIG. 4 replaced with steps S14*a*, S17*a* and S18*a*, respectively.

In step S14*a*, band-pass filtering to extract the sum frequency (fSUM) component is executed, and the amplitude of the extracted signal is integrated to calculate the sum frequency component intensity MSUM. In step S17*a*, the sum frequency component intensity MSUM is divided by the oscillation frequency component intensity MOSL to calculate the decision parameter RST. In step S18*a*, it is determined whether the decision parameter RST is greater than a decision parameter threshold value RSTTH1*a*.

The decision parameter threshold value RSTTH1*a* is set smaller than the decision parameter threshold value RSTTH1 used in the foregoing embodiment.

According to the modification, the oscillation signal amplitude AOSL is likewise eliminated in the equation 12, so that even when the real air-fuel ratio oscillation amplitude differs from the amplitude of the control input, imbalance failure determination can be carried out without being influenced by the difference.

According to the modification, step S14*a* in FIG. 5 is equivalent to the sum/difference frequency component intensity calculator, step S17*a* in FIG. 5 is equivalent to the decision parameter calculator, and steps S18*a* S19 and S20 in FIG. 5 are equivalent to the imbalance failure determination device.

Second Embodiment

According to the embodiment, during execution of air-fuel ratio oscillation control, all of the 0.5th-order frequency component intensity MIMB, the oscillation frequency component intensity MOSL, the difference frequency component intensity MDIF and the sum frequency component intensity MSUM are calculated, the 0.5th-order frequency component ratio RIMB is calculated from the following equation 21, the correction ratio RCR is calculated from the following equation 22, and the decision parameter RST is calculated by multiplying the 0.5th-order frequency component ratio RIMB by the correction ratio RCR (following equation 23). The second embodiment is identical to the first embodiment except for the following points.

$$RIMB=MIMB/MOSL \tag{21}$$

$$RCR=MDIF/MSUM \tag{22}$$

$$RST=RIMB\times RCR \tag{23}$$

According to the embodiment, the oscillation frequency fOSL is also set to 0.4 fNE, lower than the 0.5th-order frequency fIMB. Therefore, the oscillation frequency gain GOSL in the response frequency characteristic of the LAF sensor 15 is greater than the 0.5th-order frequency gain GIMB. According to the embodiment, therefore, the correction ratio RCR is calculated by dividing the difference frequency component intensity MDIF by the sum frequency component intensity MSUM as shown in the equation 22, and the 0.5th-order frequency component ratio RIMB is multiplied by the correction ratio RCR to achieve correction corresponding to the response frequency characteristic of the LAF sensor 15.

Substituting the equations 6 and 9 in the equation 22 yields the following equation 22a. That is, the correction ratio RCR is equal to the difference frequency gain GDIF divided by the sum frequency gain GSUM. Because the relation GDIF>GSUM is fulfilled, correction corresponding to the response frequency characteristic of the LAF sensor 15 can be carried out by multiplying the 0.5th-order frequency component ratio RIMB by the correction ratio RCR, thereby suppressing the influence of a change in the response frequency characteristic of the LAF sensor 15.

$$RCR=\frac{GDIF\times(AIMB\cdot AOSL/2)}{GSUM\times(AIMB\cdot AOSL/2)}=GDIF/GSUM \tag{22a}$$

Figure 6:
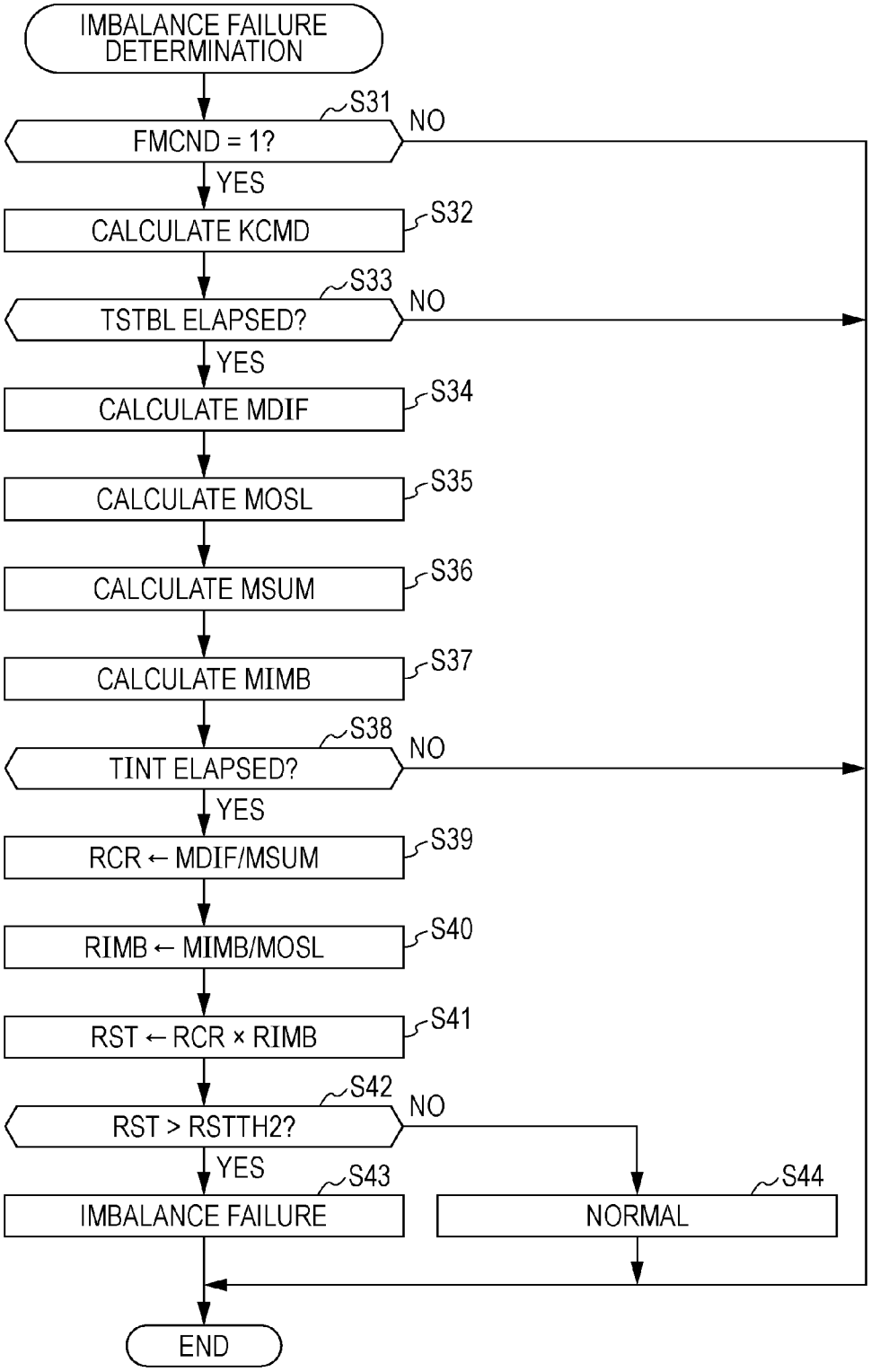
FIG. 6 is a flowchart of an imbalance failure determination routine (second embodiment).

FIG. 6 shows the flowchart of an imbalance failure determination routine according to the second embodiment. Steps S31 to S35, and S38 in this routine are respectively identical to steps S11 to S15, and S16 in FIG. 4.

In step S36, band-pass filtering to extract the sum frequency (fSUM) component is executed, and the amplitude of the extracted signal is integrated to calculate the sum frequency component intensity MSUM. In step S37, band-pass filtering to extract the 0.5th-order frequency (fIMB) component is executed, and the amplitude of the extracted signal is integrated to calculate the 0.5th-order frequency component intensity MIMB.

In step S39, the correction ratio RCR is calculated by dividing the difference frequency component intensity MDIF by the sum frequency component intensity MSUM (equation 22). In step S40, the 0.5th-order frequency component ratio RIMB is calculated by dividing the 0.5th-order frequency component intensity MIMB by the oscillation frequency component intensity MOSL (equation 21). In step S41, the decision parameter RST is calculated by multiplying the 0.5th-order frequency component ratio RIMB by the correction ratio RCR (equation 23).

In step S42, it is determined whether the decision parameter RST is greater than a decision parameter threshold value RSTTH2. When the decision in step S42 is affirmative (YES), it is decided that an imbalance failure has occurred (step S43). When the decision in step S42 is negative (NO), on the other hand, it is decided that the degree of imbalance lies within the allowable limit (step S44).

According to the embodiment, step S32 in FIG. 6 is equivalent to the oscillation signal generator, steps S34 and S36 in FIG. 6 are equivalent to the sum/difference frequency component intensity calculator, step S35 in FIG. 6 is equivalent to the set frequency component intensity calculator, steps S39 to S41 in FIG. 6 are equivalent to the decision parameter calculator, and steps S42 to S44 in FIG. 6 are equivalent to the imbalance failure determination device.

Modification

Although the oscillation frequency fOSL is set to 0.4 fNE as an example according to the second embodiment, the oscillation frequency fOSL may be set to a frequency higher than 0.5 fNE, e.g., 0.6 fNE.

Figure 7:
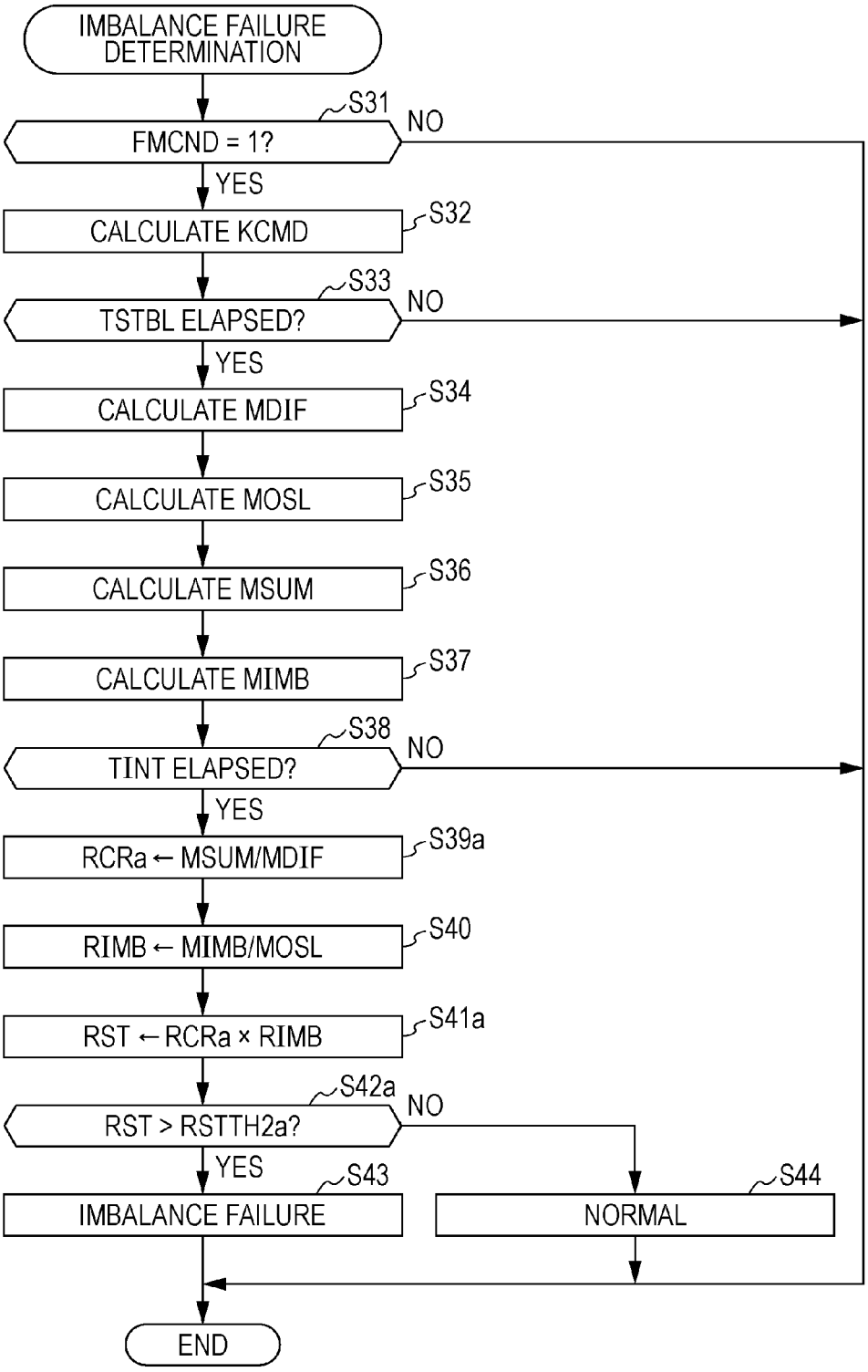
FIG. 7 is a flowchart of an imbalance failure determination routine (modification of the second embodiment).

FIG. 7 shows the flowchart of an imbalance failure determination routine according to this modification. In this routine, steps S39, S41 and S42 in FIG. 6 are replaced with steps S39*a*, S41*a* and S42*a*, respectively.

In step S39*a*, the correction ratio RCRa is calculated by dividing the sum frequency component intensity MSUM by the difference frequency component intensity MDIF. In step S41*a*, the decision parameter RST is calculated by multiplying the 0.5th-order frequency component ratio RIMB by the correction ratio RCRa.

In step S42*a*, it is determined whether the decision parameter RST is greater than the decision parameter threshold value RSTTH2*a*.

According to the modification, the oscillation frequency fOSL is set to 0.6 fNE, higher than the 0.5th-order frequency fIMB. Therefore, the oscillation frequency gain GOSL in the response frequency characteristic of the LAF sensor 15 is smaller than the 0.5th-order frequency gain GIMB. According to the modification, therefore, the correction ratio RCRa is calculated by dividing the sum frequency component intensity MSUM by the difference frequency component intensity MDIF, and the 0.5th-order frequency component ratio RIMB is multiplied by the correction ratio RCRa to achieve correction corresponding to the response frequency characteristic of the LAF sensor 15.

Because the correction ratio RCRa is equal to the sum frequency gain GSUM divided by the difference frequency gain GDIF (GSUM/GDIF), correction corresponding to the response frequency characteristic of the LAF sensor 15 can be carried out by multiplying the 0.5th-order frequency component ratio RIMB by the correction ratio RCRa, thereby suppressing the influence of a change in the response frequency characteristic of the LAF sensor 15.

According to the modification, steps S39*a*, S40 and S41*a* are equivalent to the decision parameter calculator, and steps S42*a*, S43 and S44 are equivalent to the imbalance failure determination device.

Third Embodiment

The third embodiment is the first embodiment in which correction corresponding to the response frequency characteristic of the LAF sensor 15 is introduced. That is, the difference frequency component ratio RDIF (equivalent to the decision parameter RST in the first embodiment) is calculated by dividing the difference frequency component intensity MDIF by the oscillation frequency component intensity MOSL (equation 31), the correction ratio RCRa according to the modification of the second embodiment is calculated (equation 32), and the decision parameter RST is calculated by multiplying the difference frequency component ratio RDIF by the correction ratio RCRa (following equation 33). The decision parameter RST calculated in this manner is identical to the decision parameter RST according to the modification of the first embodiment. The third embodiment is identical to the first embodiment except for the following points.

$$RDIF=MDIF/MOSL \tag{31}$$

$$RCRa=MSUM/MDIF \tag{32}$$

$$RST=RCRa\times RDIF \tag{33}$$

Figure 8:
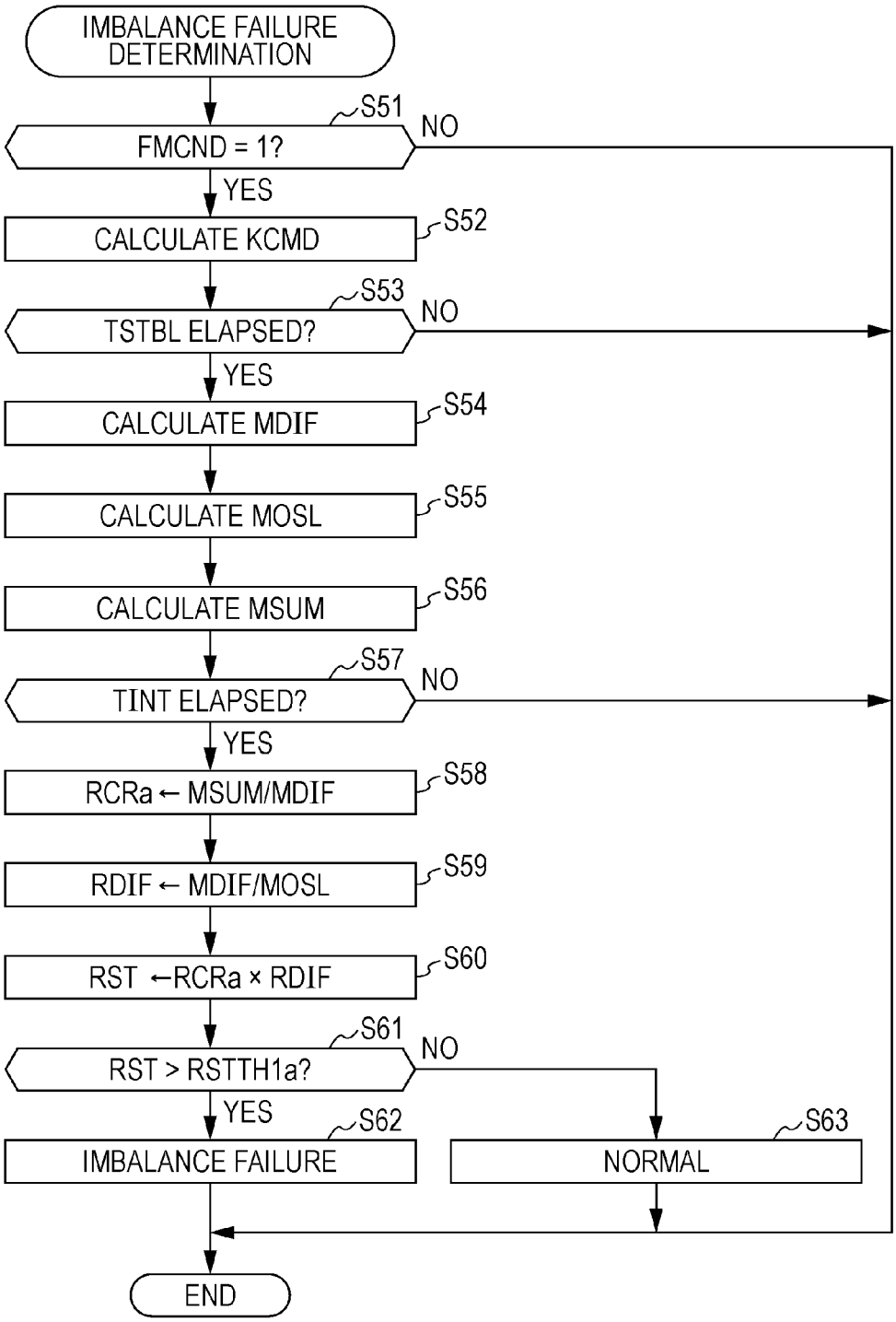
FIG. 8 is a flowchart of an imbalance failure determination routine (third embodiment).

FIG. 8 shows the flowchart of an imbalance failure determination routine according to the third embodiment. Steps S51 to S56, and S57 in this routine are respectively identical to steps S31 to S36, and S38 in FIG. 6.

In step S58, the correction ratio RCRa is calculated by dividing the sum frequency component intensity MSUM by the difference frequency component intensity MDIF. In step S59, the difference frequency component ratio RDIF is calculated by dividing the difference frequency component intensity MDIF by the oscillation frequency component intensity MOSL. In step S60, the decision parameter RST is calculated by multiplying the difference frequency component ratio RDIF by the correction ratio RCRa.

In step S61, it is determined whether the decision parameter RST is greater than the decision parameter threshold value RSTTH1*a*. When the decision in step S61 is affirmative (YES), it is decided that an imbalance failure has occurred (step S62). When the decision in step S61 is negative (NO), on the other hand, it is decided that the degree of imbalance lies within the allowable limit (step S63).

According to the embodiment, the difference frequency component ratio RDIF is proportional to the 0.5th-order frequency component intensity MIMB, and is not influenced by the oscillation control amplitude, and the response frequency characteristic of the LAF sensor 15 in the frequency range including the 0.5th-order frequency and the set frequency is reflected on the correction ratio RCRa, so that multiplying the difference frequency component ratio RDIF by the correction ratio RCRa makes it possible to suppress the influence of a variation in the response frequency characteristic of the LAF sensor 15 and cancel the influence of the oscillation amplitude of the air-fuel ratio oscillation control, thereby ensuring accurate determination of an imbalance failure.

According to the embodiment, step S52 in FIG. 8 is equivalent to the oscillation signal generator, steps S54 and S56 in FIG. 6 are equivalent to the sum/difference frequency component intensity calculator, step S55 in FIG. 6 is equivalent to the set frequency component intensity calculator, steps S58 to S63 in FIG. 8 are equivalent to the decision parameter calculator, and steps S61 to S63 in FIG. 8 are equivalent to the imbalance failure determination device.

Modification

Figure 9:
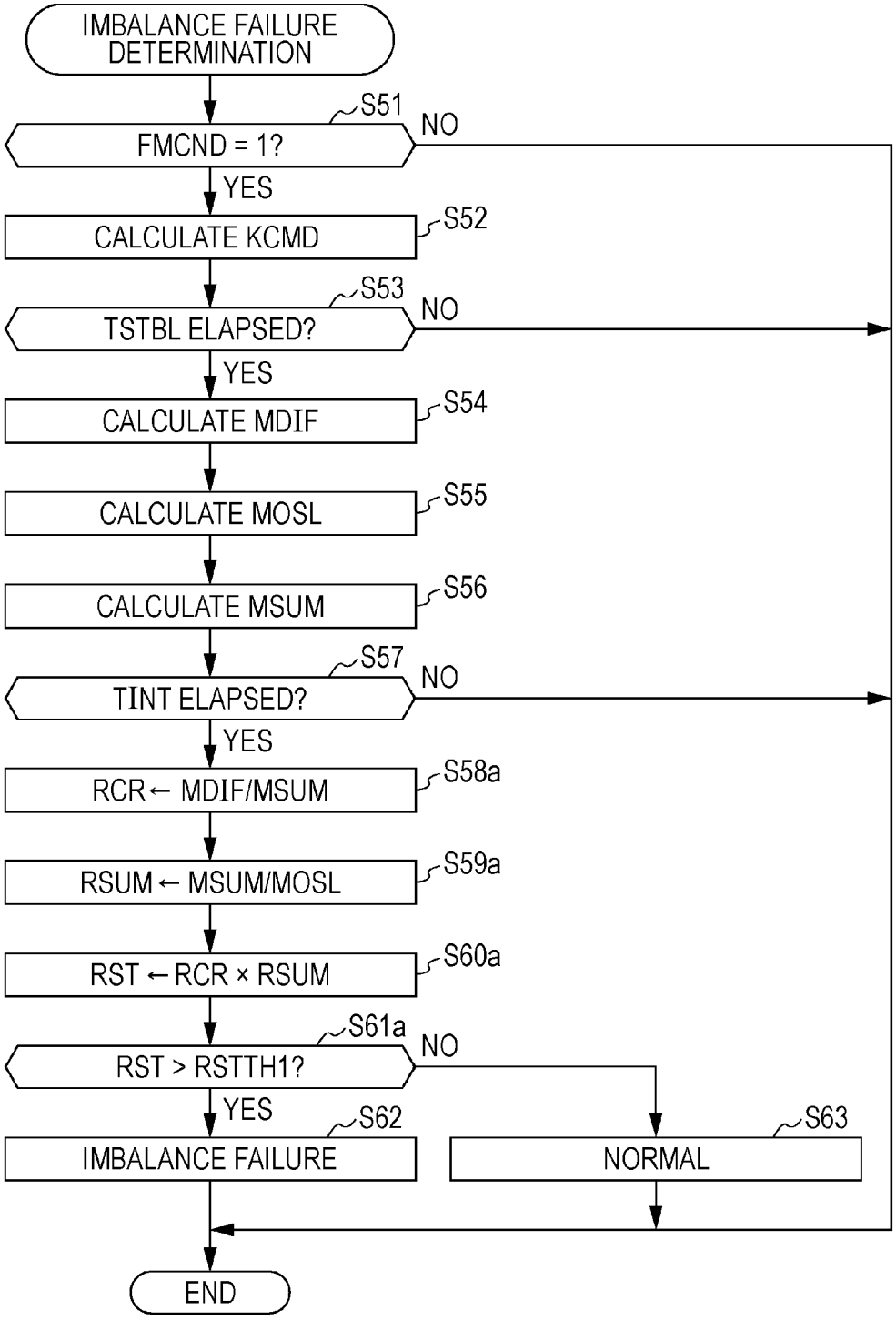
FIG. 9 is a flowchart of an imbalance failure determination routine (modification of the third embodiment).

The routine in FIG. 8 may be modified as illustrated in FIG. 9. In the routine in FIG. 9, steps S58 to S61 in FIG. 8 are replaced with steps S58*a* to S61*a*, respectively.

In step S58*a*, the correction ratio RCR is calculated by dividing the difference frequency component intensity MDIF by the sum frequency component intensity MSUM. In step S59*a*, a sum frequency component ratio RSUM is calculated by dividing the sum frequency component intensity MSUM by the oscillation frequency component intensity MOSL. In step S60*a*, the decision parameter RST is calculated by multiplying the sum frequency component ratio RSUM by the correction ratio RCR.

In step S61*a*, it is determined whether the decision parameter RST is greater than the decision parameter threshold value RSTTH1.

According to the modification, the sum frequency component ratio RSUM is proportional to the 0.5th-order frequency component intensity MIMB, and is not influenced by the oscillation control amplitude, and the response frequency characteristic of the LAF sensor 15 in the frequency range including the 0.5th-order frequency and the set frequency is reflected on the correction ratio RCR, so that multiplying the sum frequency component ratio RSUM by the correction ratio RCR makes it possible to suppress the influence of a variation in the response frequency characteristic of the LAF sensor 15 and cancel the influence of the oscillation amplitude of the air-fuel ratio oscillation control, thereby ensuring accurate determination of an imbalance failure.

According to the modification, steps S58*a* to S60*a* in FIG. 9 are equivalent to the decision parameter calculator, and steps S61*a*, S62 and S63 are equivalent to the imbalance failure determination device.

The disclosure is not limited to the foregoing embodiments, and can be modified in various other forms. As apparent from the equations 6 and 9, for example, the difference frequency component intensity MDIF and the sum frequency component intensity MSUM are proportional to the amplitude AIMB of the 0.5th-order frequency component, so that the difference frequency component intensity MDIF or the sum frequency component intensity MSUM may be used directly as the decision parameter RST.

Although the oscillation frequency fOSL is set to a constant multiplication of the engine speed frequency fNE (frequency synchronized with the engine speed) according to the foregoing embodiments, the oscillation frequency fOSL may be set to a fixed frequency of, for example, 4 Hz or so. When the oscillation frequency fOSL is set to a fixed frequency, however, it is desirable to limit the range of the engine speed NE under the condition for executing imbalance failure determination to a comparatively narrow range.

The process of calculating the frequency component intensity may be executed in an optimal execution period separately from the imbalance failure determination routine. In this case, the calculation of the frequency component intensity is not executed in the imbalance failure determination routine, the frequency component intensities (oscillation frequency component intensity MOSL, difference frequency component intensity MDIF, sum frequency component intensity MSUM, 0.5th-order frequency component intensity MIMB) calculated in the frequency component intensity calculating process which is executed in parallel to the imbalance failure determination routine are read to be used in the determination routine. Further, in a predetermined sampling period from the point of time at which air-fuel ratio oscillation control has become stable, the LAF-sensor output signal SLAF is sampled in an optimal period, and the sampled data is stored in a memory, and is collectively processed to calculate the individual frequency component intensities after the predetermined sampling period ends. In this case, FFT (Fast Fourier Transformation) may be used.

Although calculation of the 0.5th-order frequency component intensity MIMB is executed during air-fuel ratio oscillation control according to the foregoing embodiments, the calculation may be executed when the air-fuel ratio oscillation control is not underway. In this case, it is desirable that the engine operational area for which the oscillation frequency component intensity MOSL, the difference frequency component intensity MDIF and the sum frequency component intensity MSUM are calculated should be limited to a comparatively narrow range, and the calculation of the 0.5th-order frequency component intensity MIMB should be performed in the limited engine operational area.

The disclosure may be adapted to an air-fuel ratio control apparatus for a ship propelling engine such as an outboard engine having the crank shaft set vertically.

An air-fuel ratio control apparatus according to the embodiments, for an internal combustion engine having a plurality of cylinders, includes an air-fuel ratio detection unit (15) that detects an air-fuel ratio in an exhaust passage of the internal combustion engine; an oscillation signal generator that generates an oscillation signal for oscillating the air-fuel ratio at a set frequency (fOSL) different from a 0.5th-order frequency (fIMB) which is a half of a frequency (fNE) corresponding to a rotational speed (NE) of the engine; an air-fuel ratio oscillation unit that oscillates the air-fuel ratio according to the oscillation signal; a sum/difference frequency component intensity calculation unit that calculates, while the air-fuel ratio oscillation unit is in operation, at least one of a component intensity (MDIF) of a difference frequency corresponding to a difference between the 0.5th-order frequency (fIMB) and the set frequency (fOSL), both included in an output signal of the air-fuel ratio detection unit and a component intensity (MSUM) of a sum frequency corresponding to a sum of the 0.5th-order frequency (fIMB) and the set frequency (fOSL), both included in the output signal of the air-fuel ratio detection unit; a decision parameter calculation unit that calculates a decision parameter (RST) for determining a degree of imbalance of the air-fuel ratio corresponding to each of the plurality of cylinders according to at least one of the component (MDIF) intensity of the difference frequency and the component intensity (MSUM) of the sum frequency; and an imbalance failure determination unit that determines an imbalance failure wherein the degree of imbalance of the air-fuel ratio exceeds an allowable limit using the decision parameter (RST).

An air-fuel ratio oscillation control is for oscillating the air-fuel ratio at the set frequency different from the 0.5th-order frequency which is half the frequency corresponding to the rotational speed of the engine is executed, and while the air-fuel ratio oscillation unit is in operation, at least one of the component intensity of the difference frequency corresponding to the difference between the 0.5th-order frequency and the set frequency, both included in an output signal of the air-fuel ratio detection unit, and the component intensity of the sum frequency corresponding to the sum of the 0.5th-order frequency and the set frequency is calculated, the decision parameter for determining the degree of imbalance of the air-fuel ratio corresponding to each of a plurality of cylinders according to at least one of the difference frequency component intensity and the sum frequency component intensity, and an imbalance failure wherein the degree of imbalance of the air-fuel ratio exceeds the allowable limit is determined using the calculated decision parameter. Because each of the difference frequency component intensity and the sum frequency component intensity is proportional to the 0.5th-order frequency component intensity and the set frequency component intensity, it is possible to suppress the influence of a variation in the response frequency characteristic of the air-fuel ratio detection unit or the influence of the oscillation amplitude in the air-fuel ratio oscillation control by calculating the decision parameter according to the difference frequency component intensity and/or the sum frequency component intensity, thereby ensuring accurate determination of an imbalance failure.

It is preferable that the air-fuel ratio control apparatus according to the embodiments should further include a set frequency component intensity calculation unit that calculates a component intensity (MOSL) of the set frequency included in the output signal of the air-fuel ratio detection unit while the air-fuel ratio oscillation unit is in operation, wherein the sum/difference frequency component intensity calculation unit calculates both of the component intensity (MDIF) of the difference frequency and the component intensity (MSUM) of the sum frequency, and the decision parameter calculation unit includes a difference frequency component ratio calculation unit that calculates a difference frequency component ratio (RDIF) by dividing the component intensity (MDIF) of the difference frequency by the component intensity (MOSL) of the set frequency, and a correction ratio calculation unit that calculates a correction ratio (RCR) by dividing the component intensity (MSUM) of the sum frequency by the component intensity (MDIF) of the difference frequency, and calculates the decision parameter by multiplying the difference frequency component ratio (RDIF) by the correction ratio (RCR).

According to the embodiments, while the air-fuel ratio oscillation unit is in operation, the component intensity of the set frequency included in the output signal of the air-fuel ratio detection unit is calculated, the difference frequency component ratio is calculated by dividing the difference frequency component intensity by the set frequency component intensity, the correction ratio is calculated by dividing the sum frequency component intensity by the difference frequency component intensity, and the decision parameter is calculated by multiplying the difference frequency component ratio by the correction ratio. The difference frequency component intensity is proportional to the 0.5th-order frequency component intensity, and is not influenced by the oscillation control amplitude, and the response frequency characteristic of the air-fuel ratio detection unit in a frequency range including the 0.5th-order frequency and the set frequency is reflected on the correction ratio, so that it is possible to suppress the influence of a variation in the response frequency characteristic of the air-fuel ratio detection unit and the influence of the oscillation amplitude in the air-fuel ratio oscillation control by multiplying the difference frequency component ratio by the correction ratio, thereby ensuring accurate determination of an imbalance failure.

It is preferable that the air-fuel ratio control apparatus according to the embodiments should further include a set frequency component intensity calculation unit that calculates a component intensity (MOSL) of the set frequency included in the output signal of the air-fuel ratio detection unit while the air-fuel ratio oscillation unit is in operation, wherein the sum/difference frequency component intensity calculation unit calculates both of the component intensity (MDIF) of the difference frequency and the component intensity (MSUM) of the sum frequency, and the decision parameter calculation unit includes a sum frequency component ratio calculation unit that calculates a sum frequency component ratio (RSUM) by dividing the component intensity (MSUM) of the sum frequency by the component intensity (MOSL) of the set frequency, and a correction ratio calculation unit that calculates a correction ratio (RCRa) by dividing the component intensity (MDIF) of the difference frequency by the component intensity (MSUM) of the sum frequency, and calculates the decision parameter (RST) by multiplying the sum frequency component ratio (RSUM) by the correction ratio (RCRa).

According to the embodiments, while the air-fuel ratio oscillation unit is in operation, the component intensity of the set frequency included in the output signal of the air-fuel ratio detection unit is calculated, the sum frequency component ratio is calculated by dividing the sum frequency component intensity by the set frequency component intensity, the correction ratio is calculated by dividing the difference frequency component intensity by the sum frequency component intensity, and the decision parameter is calculated by multiplying the sum frequency component ratio by the correction ratio. The sum frequency component intensity is proportional to the 0.5th-order frequency component intensity, and is not influenced by the oscillation control amplitude, and the response frequency characteristic of the air-fuel ratio detection unit in a frequency range including the 0.5th-order frequency and the set frequency is reflected on the correction ratio, so that it is possible to suppress the influence of a variation in the response frequency characteristic of the air-fuel ratio detection unit and the influence of the oscillation amplitude in the air-fuel ratio oscillation control by multiplying the sum frequency component ratio by the correction ratio, thereby ensuring accurate determination of an imbalance failure.

It is preferable that the air-fuel ratio control apparatus according to the embodiments should further include a set frequency component intensity calculation unit that calculates a component intensity (MOSL) of the set frequency included in the output signal of the air-fuel ratio detection unit while the air-fuel ratio oscillation unit is in operation, wherein the decision parameter calculation unit calculates the decision parameter (RST) by dividing the component intensity (MDIF) of the difference frequency or the component intensity (MSUM) of the sum frequency by the component intensity (MOSL) of the set frequency.

According to the embodiments, the component intensity of the set frequency included in the output signal of the air-fuel ratio detection unit is calculated, and the decision parameter is calculated by dividing the difference frequency component intensity or the sum frequency component intensity by the set frequency component intensity. The division of the difference frequency component intensity or the sum frequency component intensity by the set frequency component intensity provides a decision parameter which is proportional to the 0.5th-order frequency component intensity, and is not influenced by the oscillation control amplitude. It is therefore possible to cancel the influence of the oscillation amplitude in the air-fuel ratio oscillation control, thereby ensuring accurate determination of an imbalance failure.

It is preferable that the air-fuel ratio control apparatus according to the embodiments should further include a 0.5th-order frequency component intensity calculation unit that calculates a component intensity (MIMB) of the 0.5th-order frequency included in the output signal of the air-fuel ratio detection unit, and a set frequency component intensity calculation unit that calculates a component intensity (MOSL) of the set frequency included in the output signal of the air-fuel ratio detection unit while the air-fuel ratio oscillation unit is in operation, wherein the sum/difference frequency component intensity calculation unit calculates both of the component intensity (MDIF) of the difference frequency and the component intensity (MSUM) of the sum frequency, the decision parameter calculation unit includes a 0.5th-order frequency component ratio calculation unit that calculates a 0.5th-order frequency component ratio (RIMB) by dividing the component intensity (MIMB) of the 0.5th-order frequency by the component intensity (MOSL) of the set frequency, and a correction ratio calculation unit that calculates a correction ratio (RCR) by dividing the component intensity (MDIF) of the difference frequency by the component intensity (MSUM) of the sum frequency when the set frequency (fOSL) is lower than the 0.5th-order frequency (fIMB), and calculates the correction ratio (RCRa) by dividing the component intensity (MSUM) of the sum frequency by the component intensity (MDIF) of the difference frequency when the set frequency (fOSL) is higher than the 0.5th-order frequency (fIMB), and calculates the decision parameter by multiplying the 0.5th-order frequency component ratio (RIMB) by the correction ratio (RCR, RCRa).

According to the embodiments, the component intensity of the 0.5th-order frequency and the component intensity of the set frequency both included in the output signal of the air-fuel ratio detection unit are calculated, the 0.5th-order frequency component ratio is calculated by dividing the 0.5th-order frequency component intensity by the set frequency component intensity, the correction ratio is calculated by dividing the difference frequency component intensity by the sum frequency component intensity when the set frequency is lower than the 0.5th-order frequency whereas the correction ratio is calculated by dividing the sum frequency component intensity by the difference frequency component intensity when the set frequency is higher than the 0.5th-order frequency, and the decision parameter is calculated by multiplying the 0.5th-order frequency component ratio by the correction ratio. The response frequency characteristic of the air-fuel ratio detection unit in a frequency range including the 0.5th-order frequency and the set frequency is reflected on the correction ratio, and the correction ratio is calculated according to the level relation between the 0.5th-order frequency and the set frequency, so that the decision parameter that corrects the high-frequency attenuation characteristic of the air-fuel ratio detection unit. This makes it possible to suppress the influence of a variation in the response frequency characteristic of the air-fuel ratio detection unit, thereby ensuring accurate determination of an imbalance failure.

Obviously, numerous modifications and variations of the present invention are possible in light of the above teachings. It is therefore to be understood that within the scope of the appended claims, the invention may be practiced otherwise than as specifically described herein.

What is claimed is:

1. An air-fuel ratio control apparatus for an internal combustion engine, comprising:

an air-fuel ratio detector configured to detect an air-fuel ratio in an exhaust passage provided in the internal combustion engine including a plurality of cylinders;

an oscillation signal generator configured to generate an oscillation signal to oscillate the air-fuel ratio at an oscillation frequency different from a 0.5th-order frequency which is a half of a frequency corresponding to a rotational speed of the internal combustion engine;

an air-fuel ratio oscillation device configured to oscillate the air-fuel ratio according to the oscillation signal;

a sum/difference frequency component intensity calculator configured to calculate, while the air-fuel ratio oscillation device is in operation, at least one of a component intensity of a difference frequency and a component intensity of a sum frequency, the difference frequency representing a difference between the 0.5th-order frequency and the oscillation frequency which are included in an output signal of the air-fuel ratio detector, the sum frequency representing a sum of the 0.5th-order frequency and the oscillation frequency which are included in the output signal of the air-fuel ratio detector;

a decision parameter calculator configured to calculate, according to at least one of the component intensity of the difference frequency and the component intensity of the sum frequency, a decision parameter to determine a degree of imbalance of the air-fuel ratio corresponding to each of the plurality of cylinders;

an imbalance failure determination device configured to determine an imbalance failure in which the degree of imbalance of the air-fuel ratio exceeds an allowable limit using the decision parameter; and an oscillation frequency component intensity calculator configured to calculate, while the air-fuel ratio oscillation device is in operation, a component intensity of the oscillation frequency included in the output signal of the air-fuel ratio detector, wherein the sum/difference frequency component intensity calculator is configured to calculate both of the component intensity of the difference frequency and the component intensity of the sum frequency, the decision parameter calculator includes a difference frequency component ratio calculator and a correction ratio calculator, the difference frequency component ratio calculator is configured to calculate a difference frequency component ratio by dividing the component intensity of the difference frequency by the component intensity of the oscillation frequency, and the correction ratio calculator is configured to calculate a correction ratio by dividing the component intensity of the sum frequency by the component intensity of the difference frequency and configured to calculate the decision parameter by multiplying the difference frequency component ratio by the correction ratio and thereby correct for a variation of the output signal to the air-fuel ratio detector.

2. An air-fuel ratio control apparatus for an internal combustion engine, comprising:

an air-fuel ratio detector configured to detect an air-fuel ratio in an exhaust passage provided in the internal combustion engine including a plurality of cylinders;

an oscillation signal generator configured to generate an oscillation signal to oscillate the air-fuel ratio at an oscillation frequency different from a 0.5th-order frequency which is a half of a frequency corresponding to a rotational speed of the internal combustion engine;

an air-fuel ratio oscillation device configured to oscillate the air-fuel ratio according to the oscillation signal;

a sum/difference frequency component intensity calculator configured to calculate, while the air-fuel ratio oscillation device is in operation, at least one of a component intensity of a difference frequency and a component intensity of a sum frequency, the difference frequency representing a difference between the 0.5th-order frequency and the oscillation frequency which are included in an output signal of the air-fuel ratio detector, the sum frequency representing a sum of the 0.5th-order frequency and the oscillation frequency which are included in the output signal of the air-fuel ratio detector;

a decision parameter calculator configured to calculate, according to at least one of the component intensity of the difference frequency and the component intensity of the sum frequency, a decision parameter to determine a degree of imbalance of the air-fuel ratio corresponding to each of the plurality of cylinders;

an imbalance failure determination device configured to determine an imbalance failure in which the degree of imbalance of the air-fuel ratio exceeds an allowable limit using the decision parameter; and an oscillation frequency component intensity calculator configured to calculate, while the air-fuel ratio oscillation device is in operation, a component intensity of the oscillation frequency included in the output signal of the air-fuel ratio detector, wherein the sum/difference frequency component intensity calculator is configured to calculate both of the component intensity of the difference frequency and the component intensity of the sum frequency, the decision parameter calculator includes a sum frequency component ratio calculator and a correction ratio calculator, the sum frequency component ratio calculator is configured to calculate a sum frequency component ratio by dividing the component intensity of the sum frequency by the component intensity of the oscillation frequency, and the correction ratio calculator is configured to calculate a correction ratio by dividing the component intensity of the difference frequency by the component intensity of the sum frequency and configured to calculate the decision parameter by multiplying the sum frequency component ratio by the correction ratio and thereby correct for a variation of the output signal to the air-fuel ratio detector.

3. An air-fuel ratio control apparatus for an internal combustion engine, comprising:

an air-fuel ratio detector configured to detect an air-fuel ratio in an exhaust passage provided in the internal combustion engine including a plurality of cylinders;

an oscillation signal generator configured to generate an oscillation signal to oscillate the air-fuel ratio at an oscillation frequency different from a 0.5th-order frequency which is a half of a frequency corresponding to a rotational speed of the internal combustion engine;

an air-fuel ratio oscillation device configured to oscillate the air-fuel ratio according to the oscillation signal;

a sum/difference frequency component intensity calculator configured to calculate, while the air-fuel ratio oscillation device is in operation, at least one of a component intensity of a difference frequency and a component intensity of a sum frequency, the difference frequency representing a difference between the 0.5th-order frequency and the oscillation frequency which are included in an output signal of the air-fuel ratio detector, the sum frequency representing a sum of the 0.5th-order frequency and the oscillation frequency which are included in the output signal of the air-fuel ratio detector;

a decision parameter calculator configured to calculate, according to at least one of the component intensity of the difference frequency and the component intensity of the sum frequency, a decision parameter to determine a degree of imbalance of the air-fuel ratio corresponding to each of the plurality of cylinders;

an imbalance failure determination device configured to determine an imbalance failure in which the degree of imbalance of the air-fuel ratio exceeds an allowable limit using the decision parameter;

a 0.5th-order frequency component intensity calculator configured to calculate a component intensity of the 0.5th-order frequency included in the output signal of the air-fuel ratio detector; and an oscillation frequency component intensity calculator configured to calculate, while the air-fuel ratio oscillation device is in operation, a component intensity of the oscillation frequency included in the output signal of the air-fuel ratio detector, wherein the sum/difference frequency component intensity calculator is configured to calculate both of the component intensity of the difference frequency and the component intensity of the sum frequency, the decision parameter calculator includes a 0.5th-order frequency component ratio calculator and a correction ratio calculator, the 0.5th-order frequency component ratio calculator is configured to calculate a 0.5th-order frequency component ratio by dividing the component intensity of the 0.5th-order frequency by the component intensity of the oscillation frequency, and the correction ratio calculator is configured to calculate, if the oscillation frequency is lower than the 0.5th-order frequency, a correction ratio by dividing the component intensity of the difference frequency by the component intensity of the sum frequency, the correction ratio calculator being configured to calculate, if the oscillation frequency is higher than the 0.5th-order frequency, the correction ratio by dividing the component intensity of the sum frequency by the component intensity of the difference frequency, the correction ratio calculator being configured to calculate the decision parameter by multiplying the 0.5th-order frequency component ratio by the correction ratio and thereby correct for a variation of the output signal to the air-fuel ratio detector.

4. An air-fuel ratio control apparatus according to claim 1, for an internal combustion engine, comprising:

an air-fuel ratio detector configured to detect an air-fuel ratio in an exhaust passage provided in the internal combustion engine including a plurality of cylinders;

an oscillation signal generator configured to generate an oscillation signal to oscillate the air-fuel ratio at an oscillation frequency different from a 0.5th-order frequency which is a half of a frequency corresponding to a rotational speed of the internal combustion engine;

an air-fuel ratio oscillation device configured to oscillate the air-fuel ratio according to the oscillation signal;

a sum/difference frequency component intensity calculator configured to calculate, while the air-fuel ratio oscillation device is in operation, at least one of a component intensity of a difference frequency and a component intensity of a sum frequency, the difference frequency representing a difference between the 0.5th-order frequency and the oscillation frequency which are included in an output signal of the air-fuel ratio detector, the sum frequency representing a sum of the 0.5th-order frequency and the oscillation frequency which are included in the output signal of the air-fuel ratio detector;

a decision parameter calculator configured to calculate, according to at least one of the component intensity of the difference frequency and the component intensity of the sum frequency, a decision parameter to determine a degree of imbalance of the air-fuel ratio corresponding to each of the plurality of cylinders; and an imbalance failure determination device configured to determine an imbalance failure in which the degree of imbalance of the air-fuel ratio exceeds an allowable limit using the decision parameter, wherein the sum/difference frequency component intensity calculator is configured to calculate both of the component intensity of the difference frequency and the component intensity of the sum frequency, and wherein the decision parameter calculator includes a correction ratio calculator configured to calculate a correction ratio by dividing the component intensity of the sum frequency by the component intensity of the difference frequency and configured to calculate the decision parameter by multiplying the difference frequency component ratio by the correction ratio and thereby correct for a variation of the output signal to the air-fuel ratio detector.

5. An air-fuel ratio control apparatus comprising:

air-fuel ratio detection means for detecting an air-fuel ratio in an exhaust passage provided in an internal combustion engine including a plurality of cylinders;

oscillation signal generation means for generating an oscillation signal to oscillate the air-fuel ratio at an oscillation frequency different from a 0.5th-order frequency which is a half of a frequency corresponding to a rotational speed of the internal combustion engine;

air-fuel ratio oscillation means for oscillating the air-fuel ratio according to the oscillation signal;

sum/difference frequency component intensity calculation means for calculating, while the air-fuel ratio oscillation means is in operation, at least one of a component intensity of a difference frequency and a component intensity of a sum frequency, the difference frequency representing a difference between the 0.5th-order frequency and the oscillation frequency which are included in an output signal of the air-fuel ratio detection means, the sum frequency representing a sum of the 0.5th-order frequency and the oscillation frequency which are included in the output signal of the air-fuel ratio detection means;

decision parameter calculation means for calculating, according to at least one of the component intensity of the difference frequency and the component intensity of the sum frequency, a decision parameter to determine a degree of imbalance of the air-fuel ratio corresponding to each of the plurality of cylinders; and imbalance failure determination means for determining an imbalance failure in which the degree of imbalance of the air-fuel ratio exceeds an allowable limit using the decision parameter, wherein the sum/difference frequency component intensity calculation means is configured to calculate both of the component intensity of the difference frequency and the component intensity of the sum frequency, and wherein the decision parameter calculation means includes a correction ratio calculation means for calculating a correction ratio by dividing the component intensity of the sum frequency by the component intensity of the difference frequency and for calculating the decision parameter by multiplying the difference frequency component ratio by the correction ratio and thereby correct for a variation of the output signal to the air-fuel ratio means.

6. A method for controlling an air-fuel ratio, comprising:

detecting an air-fuel ratio in an exhaust passage provided in an internal combustion engine including a plurality of cylinders;

generating an oscillation signal to oscillate the air-fuel ratio at an oscillation frequency different from a 0.5th-order frequency which is a half of a frequency corresponding to a rotational speed of the internal combustion engine;

oscillating the air-fuel ratio according to the oscillation signal;

calculating, while the air-fuel ratio is oscillated, at least one of a component intensity of a difference frequency and a component intensity of a sum frequency, the difference frequency representing a difference between the 0.5th-order frequency and the oscillation frequency which are included in an output signal generated in the detecting of the air-fuel ratio, the sum frequency representing a sum of the 0.5th-order frequency and the oscillation frequency which are included in the output signal;

calculating, according to at least one of the component intensity of the difference frequency and the component intensity of the sum frequency, a decision parameter to determine a degree of imbalance of the air-fuel ratio corresponding to each of the plurality of cylinders;

determining an imbalance failure in which the degree of imbalance of the air-fuel ratio exceeds an allowable limit using the decision parameter;

calculating both of the component intensity of the difference frequency and the component intensity of the sum frequency; and calculating a correction ratio by dividing the component intensity of the sum frequency by the component intensity of the difference frequency and calculating the decision parameter by multiplying the difference frequency component ratio by the correction ratio and thereby correct for a variation of the output signal.

* * * * *